US005546729A

United States Patent [19]

Pienta

[11] Patent Number: 5,546,729

[45] Date of Patent: Aug. 20, 1996

[54] WRAPPING MACHINE

[75] Inventor: David J. Pienta, Lambertville, Mich.

[73] Assignee: Automatic Handling Inc., Erie, Mich.

[21] Appl. No.: 339,775

[22] Filed: Nov. 15, 1994

[51] Int. Cl.[6] ..... B65B 11/04

[52] U.S. Cl. ..... 53/211; 53/136.2; 53/214

[58] Field of Search ..... 53/211, 214, 587, 53/465, 409, 204, 136.2

[56] References Cited

U.S. PATENT DOCUMENTS

| | | | |
|---|---|---|---|
| 4,137,690 | 2/1979 | Morgan | 53/211 X |
| 4,534,151 | 8/1985 | Schneck et al. | 53/211 X |
| 4,819,408 | 4/1989 | Bertolotti | 53/211 |

OTHER PUBLICATIONS

"EconoWrap 40", Automatic Handling, Inc., one sheet, No Date.

*Primary Examiner*—James F. Coan

*Attorney, Agent, or Firm*—Emch, Schaffer, Schaub & Porcello

[57] ABSTRACT

A wrapping machine for applying a paper or a plastic film to a roll, such as a paper roll, is disclosed. The wrapping machine includes a frame having opposed side members and an upper top member. A turning assembly for receiving and rotating a roll is positioned below the top member. A header assembly, including horizontally movable headers is mounted adjacent the turning assembly. A pair of opposed, vertically movable and rotatable crimper paddles are positioned above the turning assembly. A lift is provided below the turning assembly for vertically lifting the roll.

12 Claims, 9 Drawing Sheets

WRAPPING MACHINE

BACKGROUND OF THE INVENTION

Wrapping machines are known in the art. The wrapping machine which is the subject-matter of the present invention is used to place a wrap or cover on a roll of material. The rolled material varies, but the present wrapping machine is particularly adaptable for covering rolls of paper material.

The wrap itself which is applied by the wrapping machine also varies. Typical type wraps for covering a paper roll are Kraft paper and plastic materials, such as polyethylene materials.

Wrapping machines which apply a Kraft paper or a plastic film to a paper roll are well known in the art. One of the deficiencies for prior art machines is that the machines often were multiple station machines which required the paper roll to be moved between stations to complete the wrap.

The present machine is a single station, single operator wrapping machine.

SUMMARY OF INVENTION

The present invention is directed to a single station wrapping machine for applying a Kraft paper or plastic film to a roll of material. The wrapping machine includes a frame having opposed side members and top members extending between the side members. A turning assembly is positioned below the top members and includes a driven member for rotating the roll. A motor is operatively connected to the driven member.

A header carriage is mounted adjacent the turning assembly and includes opposed movable headers for holding end disks to be applied to the ends of the roll. A pair of opposed and vertically movable crimper paddles are positioned above the header carriage. Drive mechanism is provided for vertically moving and rotating each of the crimper paddles. A motor is operatively connected to the crimper paddles for moving the paddles toward and away from one another. A lift is positioned below the turning assembly for lifting the roll upwardly from its position on the turning assembly.

DESCRIPTION OF THE PREFERRED EMBODIMENTS

Figure 3:
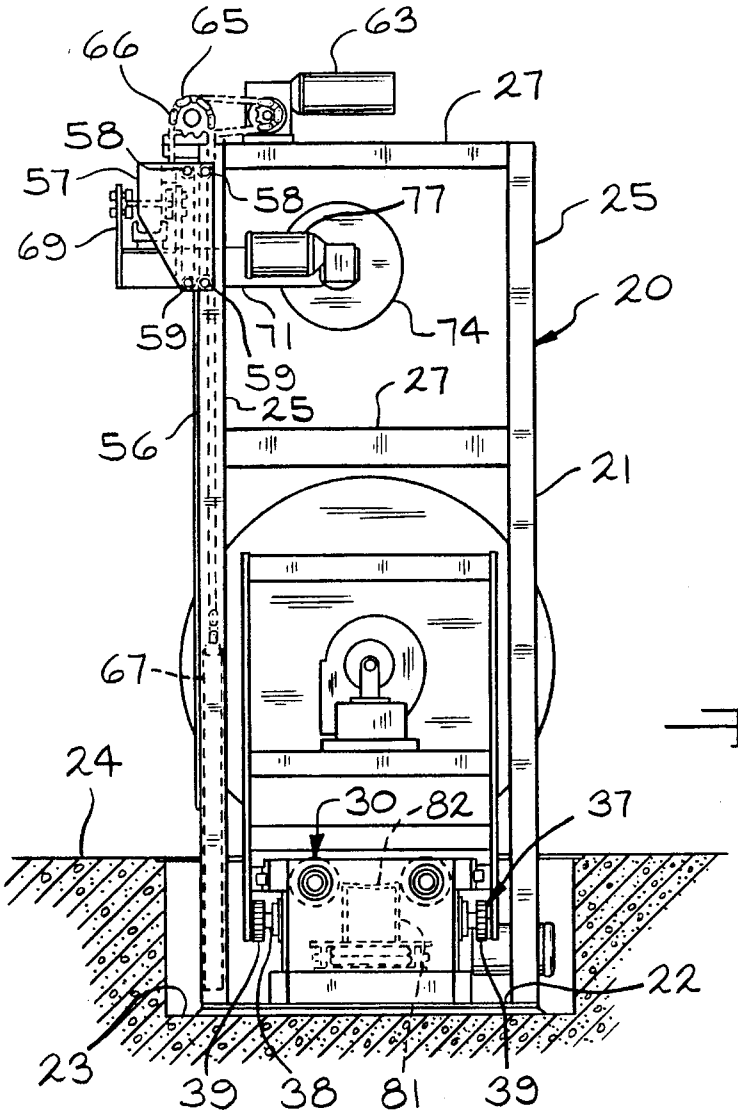
FIG. 3 is an end view of the machine shown in FIG. 1.
Figure 5:
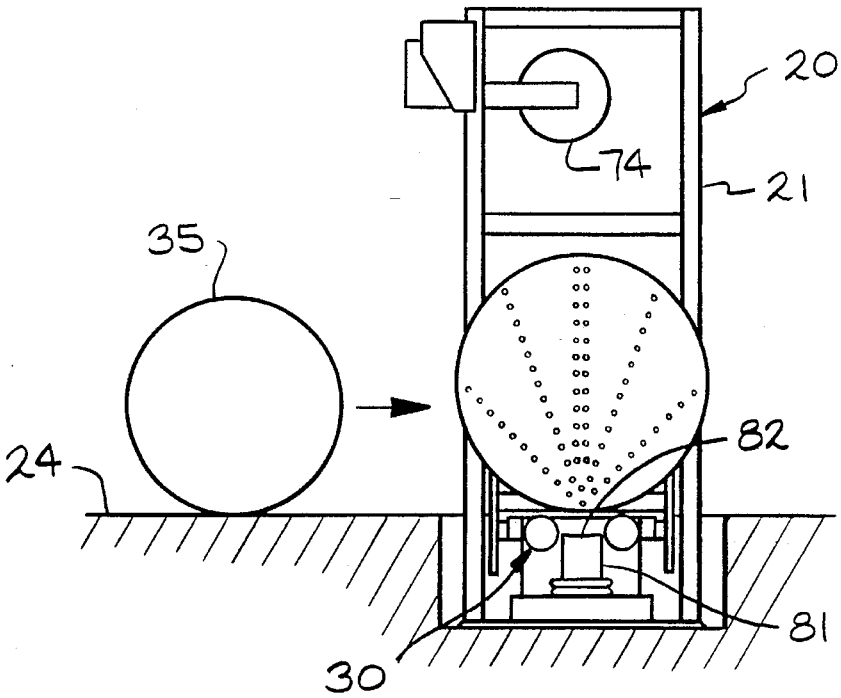
FIG. 5 is a diagrammatic end view showing a paper roll being moved into position on the wrapping machine.

Referring to the drawings, a wrapping machine, according to the present invention is generally indicated by the reference number 20. The wrapping machine 20 includes a frame 21 having base plates 22. In the present embodiment, the base plates 22 are mounted in a pit 23 which is defined below a factory floor 24. The frame 21 includes opposed side members 25 extending upwardly from the base plates 22 and a pair of spaced horizontal top members 26 extending between respective ones of the side members 25. Referring to FIG. 3, cross supports 27 extend between the side members 25. In the present embodiment, referring to FIG. 1, diagonal supports 28 extend between respective ones of the side members 25 and the top members 26.

Figure 1:
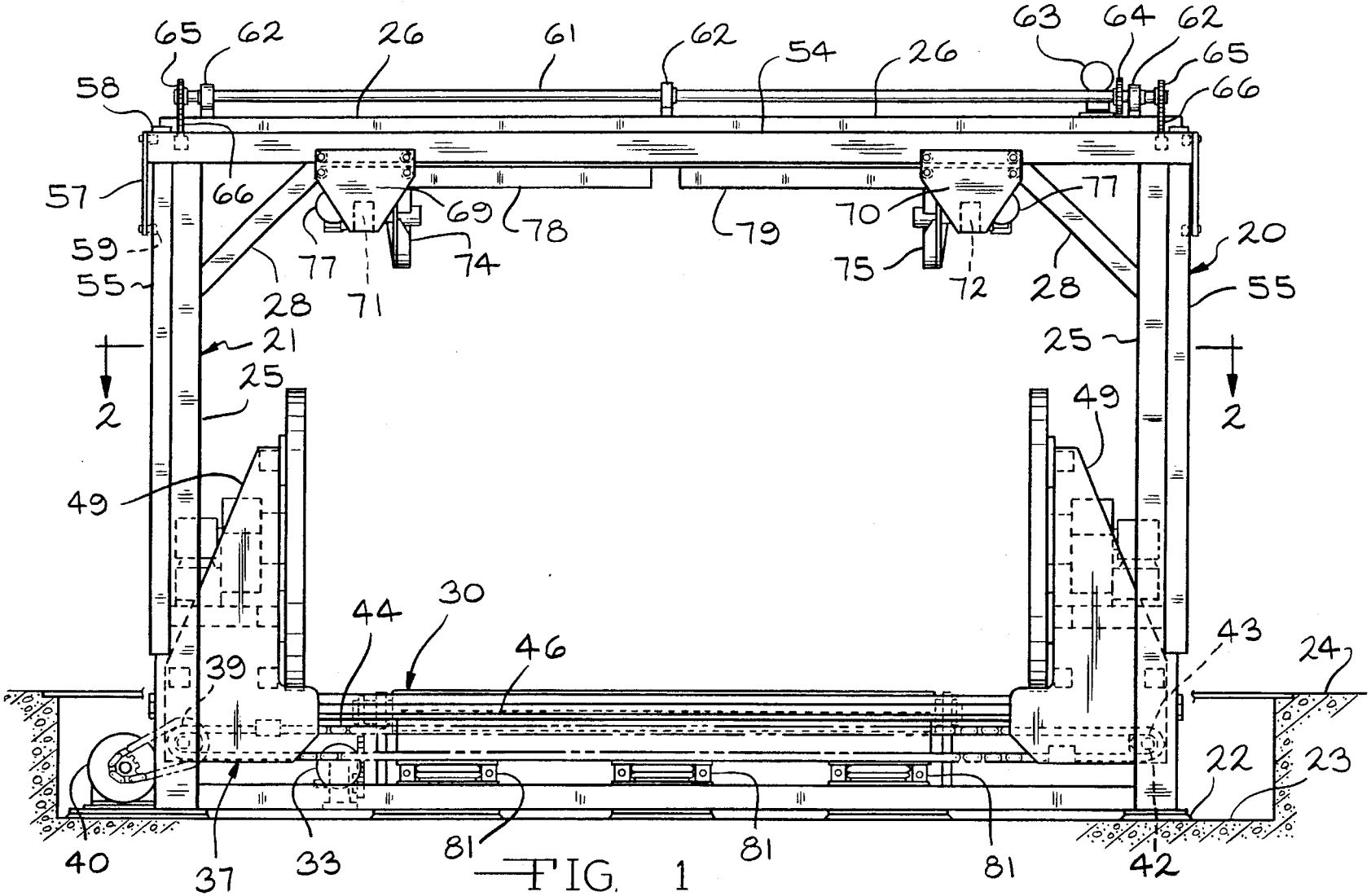
FIG. 1 is a front elevational view of a wrapping machine, according to the present invention.
Figure 2:
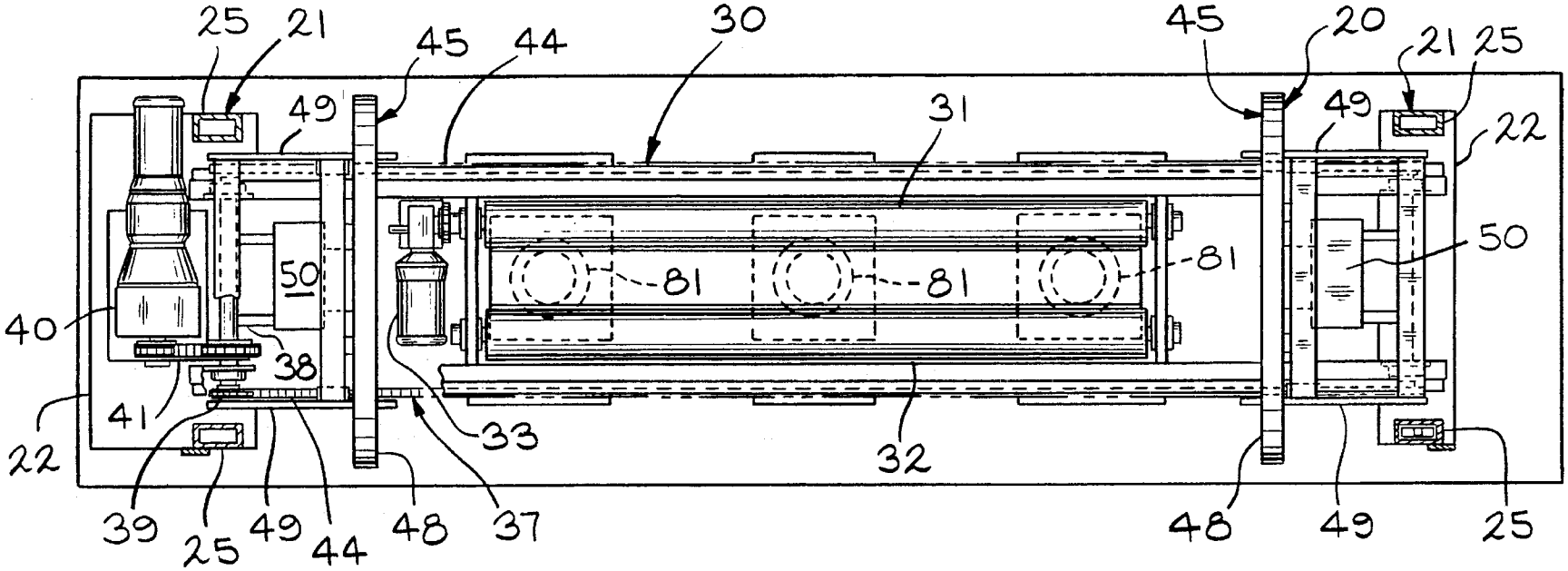
FIG. 2 is a top view taken along the line 2—2 of FIG. 1.

Referring to FIGS. 1–3, a turning assembly 30 is positioned below the top members 26. Referring to FIG. 2, the turning assembly 30 includes a horizontally disposed driven roll member 31 and an idler roll member 32. A motor 33 is operatively connected to the driven roll member 31. As shown in FIG. 1, the driven roll member 31 and idler roll member 32 have upper peripheries which preferably are at the elevation of the floor 24. This aids in positioning a roll such as a paper roll 35 in a position where the roll 35 is carried and rotated by the turning assembly 30.

A header carriage 37 is mounted adjacent the turning assembly 30 and includes a driven shaft 38 which mounts a pair of drive sprockets 39 adjacent its outer ends. A motor 40 is connected by a drive chain 41 to the driven shaft 38. Actuation of the motor 40 through the drive chain 41 rotates the driven shaft 38 and its drive sprockets 39. Referring to FIG. 1, an idler shaft 42 is mounted for rotation at the other end of the wrapping machine 20 and mounts a pair of idler sprockets 43 at each end. A pair of carriage chains 44 extend between respective ones of the drive sprockets 39 and the idler sprockets 43. The header carriage 37 includes opposed movable headers 45. A pair of horizontally disposed guide rails 46 are mounted by the frame 21 adjacent the driven roll member 31 and idler roll member 32. The headers 45 are mounted on and move along the path defined by the guide rails 46. Each of the headers 45 includes a front circular vacuum end plate 48 which is mounted on a pair of spaced side supports 49 (see FIG. 1), which in turn is mounted on the guide rails 46. Each of the headers 45 includes a blower and motor assembly 50 which is operatively connected to a respective one of the vacuum end plates 48. Actuation of the blower and motor assembly 50, operating through a plurality of vacuum openings 51 (see FIG. 4), forms a negative pressure area which holds an end disk 52 (see FIG. 11) to the face of the vacuum end plates 48. Each of the headers 45 is connected to one of the opposed carriage chains 44. When the motor 40 is activated, movement of the carriage chains 44 move the headers 45 and their vacuum end plates 48 toward and away from one another.

Referring to FIG. 1, a vertically movable horizontal cross beam 54 is mounted between opposed ones of the frame side members 25. Referring to FIGS. 1 and 3, a pair of vertical opposed guide tubes 55 are mounted on the side of the rear opposed side members 25 of the frame 21. Referring to FIG. 3, a guide plate 56 extends outwardly from each of the guide tubes 55. A pair of support plates 57 are mounted on the ends of the cross beam 54 and include two pairs of spaced upper rollers 58 and lower rollers 59. The opposed pairs of rollers 58 and 59 are mounted for movement along the guide plates 56 to guide the cross beam 54 during its vertical travel.

A horizontal shaft 61 is rotatably mounted on the top member 26 of the frame 21 by a plurality of bearings 62. A motor assembly 63 drives a gear 64 which is mounted on the horizontal shaft 61. A pair of sprockets 65 mount chains 66 which are connected to the cross beam 54. Operation of the motor assembly 63, acting through the shaft gear 64, the sprockets 65 and the chains 66 vertically move the horizontal shaft 61. The upper rollers 58 and lower rollers 59 mounted on the guide plates 56 insure the horizontal positioning of the cross beam 54 during its vertical movement. Referring to FIG. 3, in the present embodiment, counter weights 67 are operatively connected to the cross beam 54 to insure a smooth movement of the cross beam 54.

Referring to FIGS. 1 and 3, two pairs of gusset supports 69 and 70 are mounted for movement on the cross beam 54. Horizontal arms 71 and 72 extend between and outwardly from the respective gusset supports 69 and 70. A circular crimper paddle 74 is mounted adjacent the outer end of the horizontal beam 71 and a crimper paddle 75 is mounted adjacent the outer end of the horizontal arm 72. Motor drive assemblies 77 are operatively connected to the horizontal arm 71 and 72 and serve as a drive mechanism for rotating each of the respective crimper paddles 74 and 75. Rodless cylinders 78 and 79 are mounted on the cross beam 54. The rodless cylinder 78 is connected to the horizontal arm 71 for horizontally moving the crimper paddle 74. The rodless cylinder 79 is connected to the horizontal arm 72 for horizontally moving the crimper paddle 75.

Figure 10:
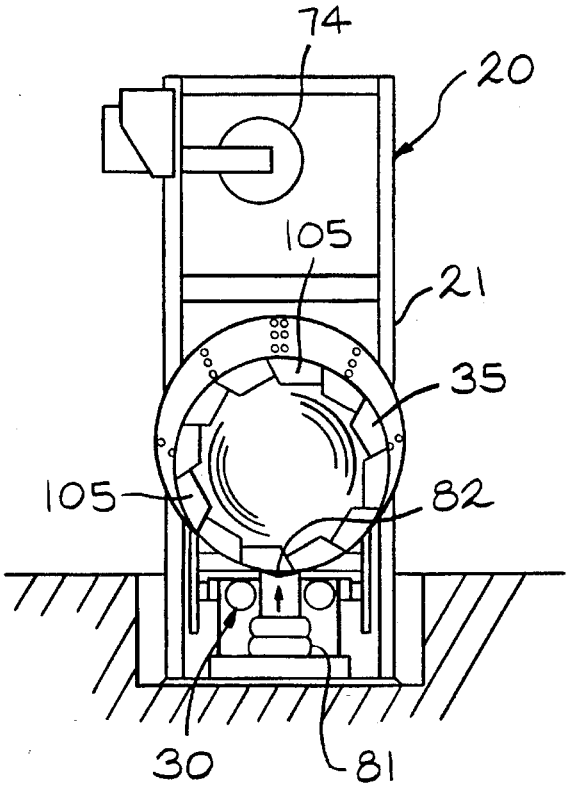
FIG. 10 is a view similar to FIG. 9 showing the paper roll lifted upwardly above the turning assembly.

Referring to FIG. 1, a plurality of lift assemblies 81 having upper ends 82 are positioned beneath the turning assembly 30 for lifting the roll 35 upwardly from the turning assembly 30, as shown in FIG. 10. In the present embodiment, the lift assemblies 81 comprise air cushions or lift actuators such as the AIRSTROKE® actuator distributed by Firestone. However, other types of lift assemblies, such as pneumatic or hydraulic cylinders can also be utilized.

Figure 14:
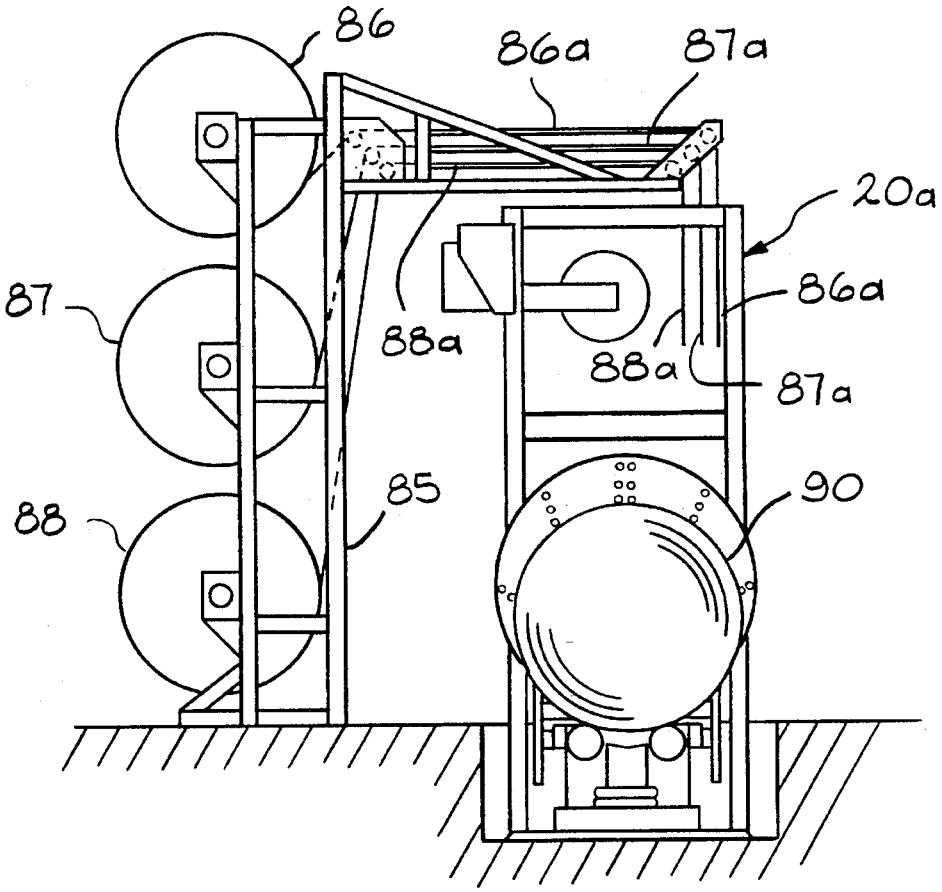
FIG. 14 is an end view, showing another embodiment of a wrapping machine, according to the present invention.

Referring to FIG. 14, in another embodiment of the present invention, a dispensing rack 85 is positioned adjacent a wrapping machine 20*a*. A plurality of rolls 86, 87 and 88 are horizontally mounted for rotation on the dispensing rack 85. The roll 86 dispenses a Kraft paper wrap 86*a* which is guided downwardly toward the roll 90 to be wrapped. Similarly, the roll 87 dispenses one grade of a polyethylene film 87*a*, while the roll 88 dispenses a second grade of a polyethylene film 88*a*. The operator chooses the type of wrap which should be applied to the roll 90.

Figure 15:
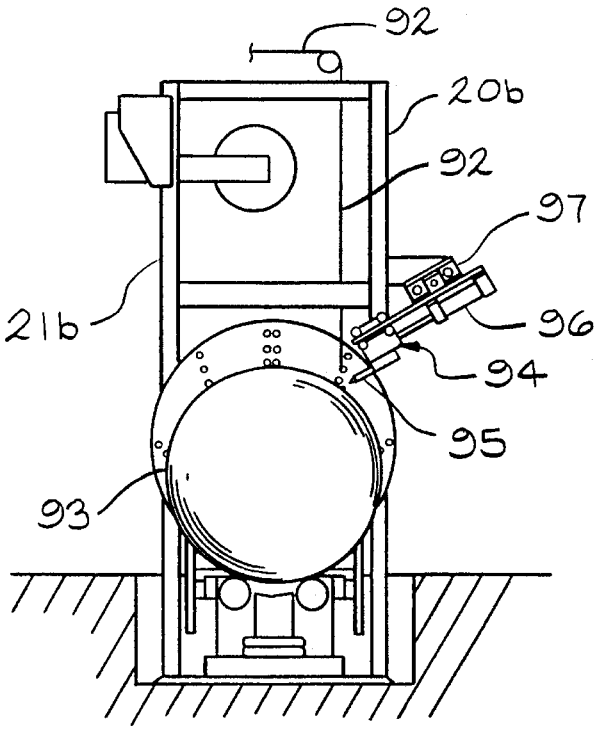
FIG. 15 is an end view showing still another embodiment of a wrapping machine, according to the present invention.

FIG. 15 discloses another embodiment of a wrapping machine 20*b* according to the present invention. The wrapping machine 20*b* moves a wrap material 92 downwardly toward a roll 93. An adhesive head assembly 94 is mounted by the frame 21*b*. The adhesive head assembly 94 includes a head 95 which dispenses a strip of adhesive on the circumference of the roll 93. The adhesive head assembly 94 includes a pneumatic cylinder 96 which is operatively connected to the head 95 to move the head toward and away from the circumference of the roll 93. The adhesive head assembly 94 also includes a bearing slide assembly 97 which mounts the head 95 for moving the head 95 along a path parallel to the longitudinal axis of the roll 93. The head 95 applies an adhesive layer to the outer cylindrical surface of the roll 93. The adhesive layer is parallel to the longitudinal centerline of the roll.

Figure 16:
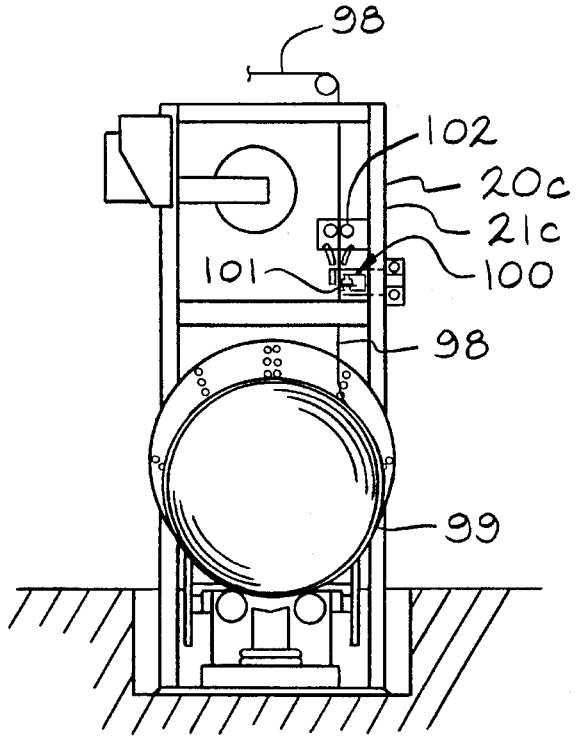
FIG. 16 is still another embodiment of a wrapping machine, according to the present invention.

Another embodiment of a wrapping machine, according to the present invention, is referred to by the reference number 20*c* in FIG. 16. The wrapping machine 20*c* includes a layer of wrap material 98 which is being applied to a roll 99. The frame 21*c* mounts a knife assembly 100 which includes a circular knife edge 101. A pair of guide rollers 102 and a guide chute direct the wrap material 98 into contact with the knife edge 101. At the end of the wrap, the knife edge 101 cuts the web of the wrap material 98. The knife edge 101 being movable to engage and sever the web. Subsequently, the end of the wrap material 98 is adhered to the outer surface to complete the final wrapped roll.

Figure 6:
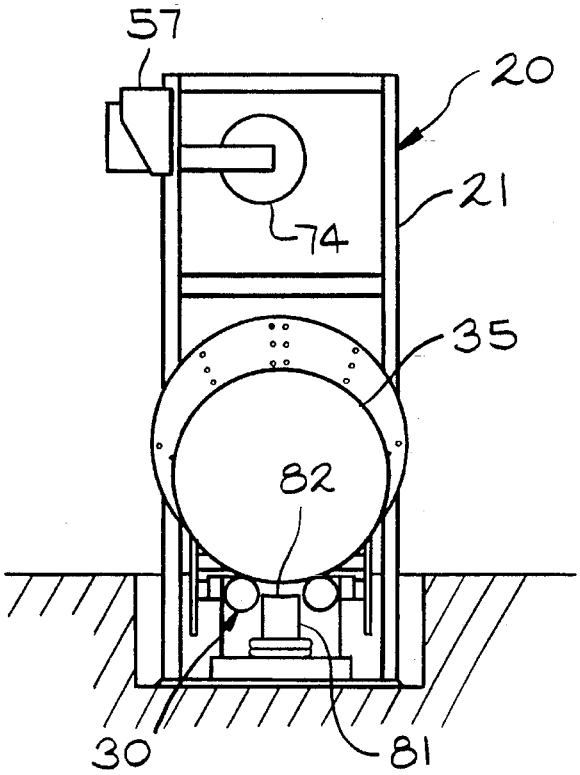
FIG. 6 is a view similar to FIG. 5 showing the paper roll positioned in the machine on the turning assembly.

Referring to FIGS. 5–13, in a typical wrapping operation using the wrapping machine 20, according to the present invention, a roll, such as the paper roll 35 is moved across the floor 24 and positioned on the turning assembly 30 between the opposed headers 45. FIG. 6 illustrates the location of the roll 35 after positioning on the turning assembly 30. A front end 104 of the wrap material 105, which in this embodiment is a Kraft paper, is adhered by a strip of adhesive 106 to the outer periphery of the paper roll 35. The front end 104 of the wrap material 105 may be either manually adhered by the operator while on the turning assembly 30 or prior to the paper roll positioning on the turning assembly 30. In other embodiments, the adhesive is automatically applied by apparatus, similar to that illustrated in FIG. 15.

Figure 7:
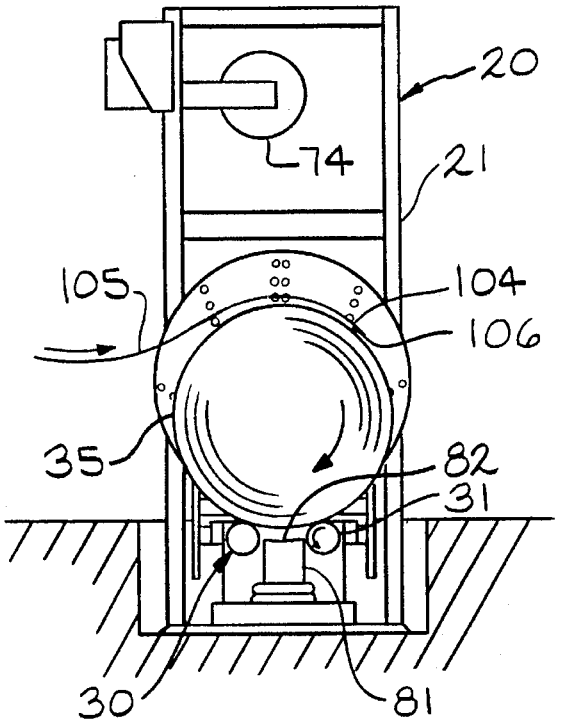
FIG. 7 is a view similar to FIG. 5 showing the paper roll being rotated and a wrap being applied.
Figure 8:
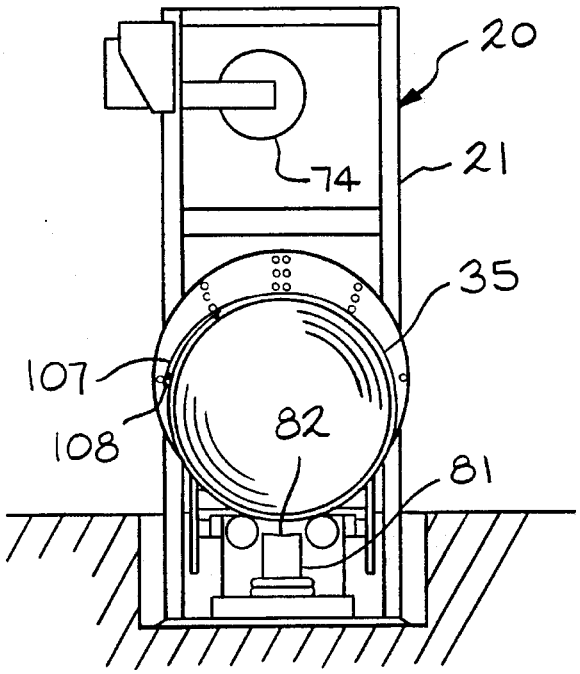
FIG. 8 is a view similar to FIG. 5 and showing the completed wrap on the roll.
Figure 9:
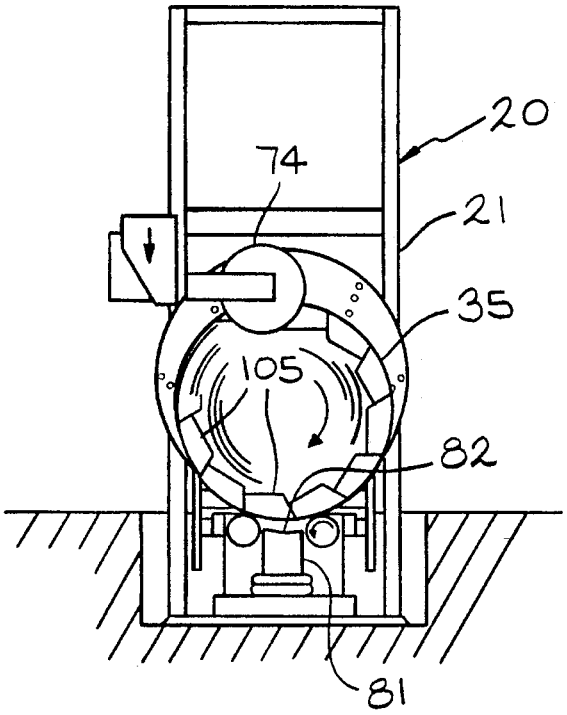
FIG. 9 is a view similar to FIG. 5 showing a crimper paddle folding the wrap against the end of the roll.

Referring to FIG. 7, the motor 33 is activated which drives the driven roller 31 of the turning assembly 30 to rotate the roll 35 and place the desired layers of the wrapping material 105 on the roll 35. After completion, the wrap material is cut, either manually or automatically as illustrated in FIG. 16. An end 107 is adhered to the roll 35 by an adhesive strip 108. While the adhesive strip 108 may be manually applied, it also can be applied by the adhesive head assembly 94 illustrated in FIG. 15. At this time, the crimper paddles 74 and 75 are moved downwardly by the operation of the motor assembly 63. The crimper paddles 74 and 75 are moved to positions adjacent the circumference of each end of the paper roll 35. The crimper paddles 74 and 75 begin to rotate by the energization of the motor drive assemblies 77. The rotating crimper paddles 74 and 75 are moved against the ends of the roll 35 to crimp the wrapping material 105 inwardly to the positions shown in FIG. 9.

Figure 4:
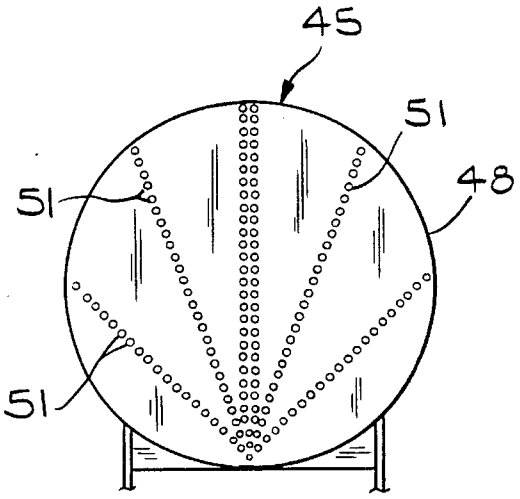
FIG. 4 is an elevational view of the vacuum end plate of a header.
Figure 11:
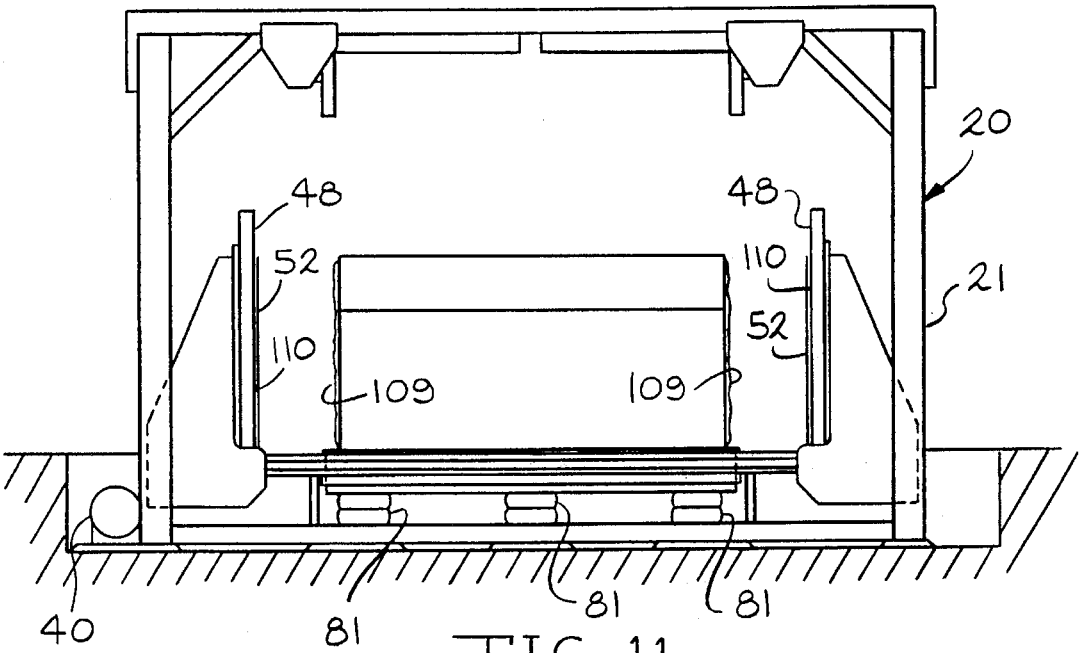
FIG. 11 is an elevational view showing an end disk positioned on each of the opposed headers and adhesive positioned on the ends of the roll.
Figure 12:
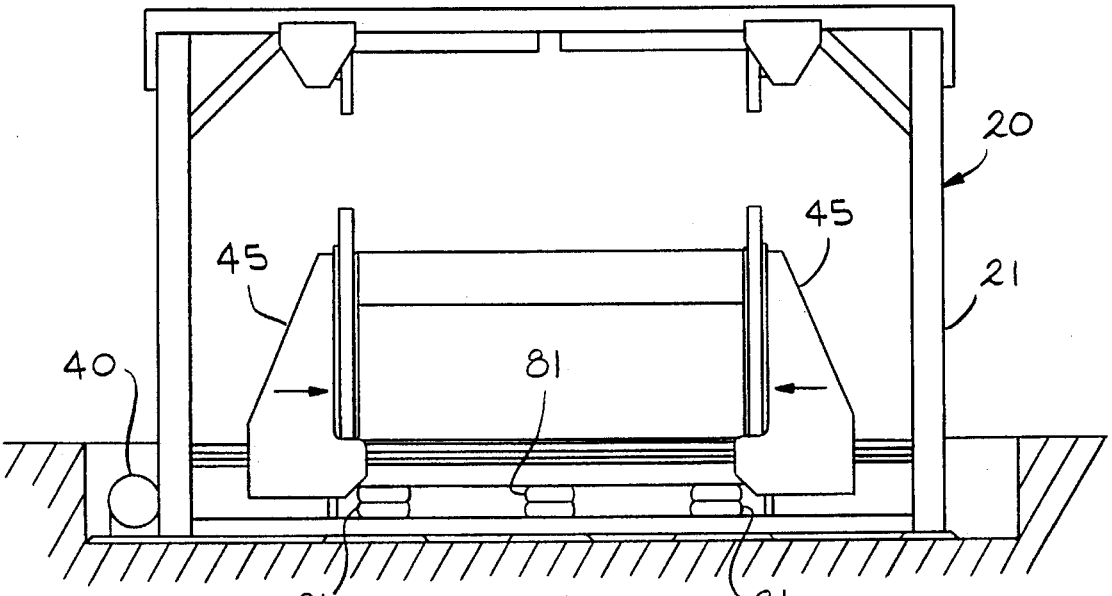
FIG. 12 is a view similar to FIG. 11 showing the headers moved into engaging relationship against the respective ends of the paper roll.
Figure 13:
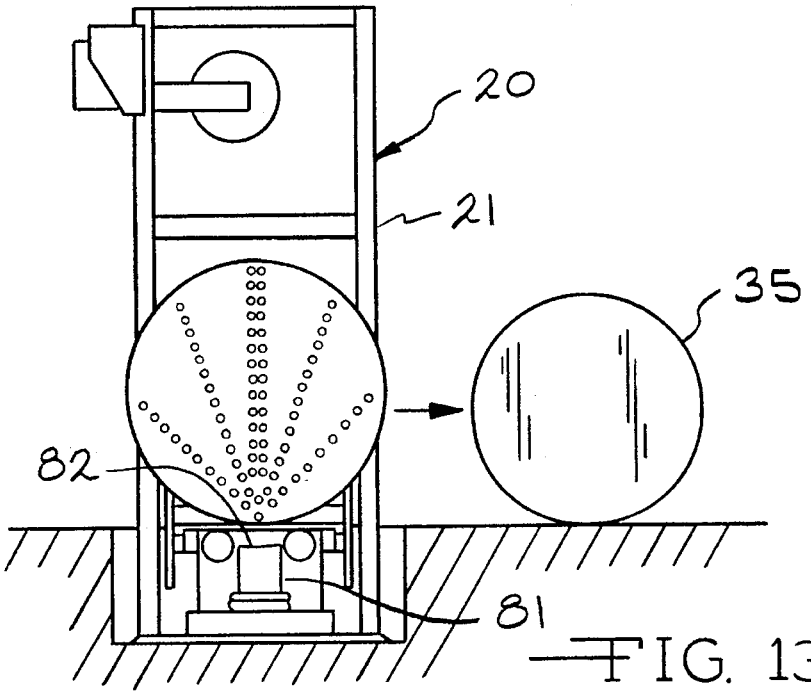
FIG. 13 is a view similar to FIG. 5, showing the completed roll being removed from the wrapping machine.

After the wrap edges are properly crimped, the motor drive assemblies are de-energized to stop rotation of the crimper paddles 74 and 75 and the rodless cylinders 78 and 79 energized to move the paddle assemblies 74 and 75 horizontally outwardly. The motor assembly 63 is energized to move the paddle assemblies 74 and 75 upwardly to the home position, shown in FIG. 10. At this time, the operator applies adhesive or glue to the crimped roll edges. As shown in FIG. 10, the lift assemblies 81 are energized and the upper ends 82 engage and move the roll 35 upwardly away from the turning assembly 30. Referring to FIG. 11, the circular strip of adhesive on the ends is referred to by the reference number 109. A header disk 52 constructed of a cardboard or similar material is positioned on the headers 45. As shown in FIG. 4, the headers 45 include the vacuum end plate 48 which holds the header disk 52 in position. The disks 52 are held against outer surfaces 110 of the end plates 48. The motor 40 of the header carriage 37 is actuated and the headers 45 and the attached header disks 52 moved inwardly into engaging position with the ends of the paper roll 35. After adherence of the header disks 52 to the ends of the paper roll 35, the headers 45 are moved outwardly and the completed roll 35 is moved away from the wrapping machine 20 as illustrated in FIG. 13. At this time, another cycle of operation can begin.

Many revisions may be made to the above described embodiments of the wrapping machines 20, 20*a*, 20*b* and 20*c* without departing from the scope of the invention or from the following claims.

I claim:

1. A wrapping machine for a roll comprising, a frame including opposed side members and top member extending between said opposed side members, a turning assembly positioned below said top member, said turning assembly including a driven member for rotating the roll, a motor operatively connected to said driven member, a header carriage mounted adjacent said turning assembly, said header carriage including opposed, moveable headers for holding an end disk and positioning the end disks on the ends of the roll, said headers including a vacuum end plate defining a plurality of openings and a blower and motor assembly in communication with, said openings, a pair of opposed and vertically moveable crimper paddles positioned above said header carriage, drive mechanism for rotating each of said crimper paddles and a motor operatively connected to said crimper paddles for rotating said crimper paddles, and a lift positioned below said turning assembly for lifting the roll upwardly from said turning assembly.

2. A wrapping machine, according to claim, 1 the roll having a longitudinal centerline and an outer cylindrical surface, including an adhesive head assembly operatively mounted on said frame, above the roll for applying an adhesive layer on said surface, parallel to said longitudinal centerline.

3. A wrapping machine, according to claim 1, wherein said header carriage includes at least one carriage chain operatively connected to said opposed movable headers and a motor operatively connected to said carriage chain, whereby operation of said motor moves said headers toward and away from one another.

4. A wrapping machine, according to claim 1, including a vertically movable cross beam horizontally disposed between opposed ones of said frame side members, said crimper paddles being operatively mounted on said cross beam.

5. A wrapping machine, according to claim 4, including a cylinder operatively connected between said cross beam and each of said crimper paddles, said cylinder moving each of said crimper paddles horizontally.

6. A wrapping machine, according to claim 1, including a web of wrapping material extending toward the roll and a knife assembly having a knife adjacent said web, said knife edge being movable to engage and sever said web.

7. A wrapping machine for a roll comprising, a frame including opposed side members and top member extending between said opposed side members, a turning assembly positioned below said top member, said turning assembly including a driven member for rotating the roll, a motor operatively connected to said driven member, a header carriage mounted adjacent said turning assembly, said header carriage including opposed, moveable headers for holding an end disk and positioning the end disks on the ends of the roll, a pair of opposed and vertically moveable crimper paddles positioned above said header carriage, drive mechanism for rotating each of said crimper paddles, a first motor operatively connected to said crimper paddles for rotating said crimper paddles, a second motor mounted adjacent said top member and cables operatively attached to said second motor and to said cross beam, whereby operation of said second motor moves said cross beam and said crimper paddles vertically, and a lift positioned below said turning assembly for lifting the roll upwardly from said turning assembly.

8. A wrapping machine according to claim 7 including guide rollers operatively connected to said cross beam, and a vertical guide plate attached to said frame for guiding said guide rollers and said cross beam along a vertical path.

9. A wrapping machine, according to claim 8, including a counter weight operatively attached to said cross beam.

10. A wrapping machine for a roll comprising, a frame including opposed side members and top member extending between said opposed side members, a turning assembly positioned below said top member, said turning assembly including a driven member for rotating the roll, a motor operatively connected to said driven member, a header carriage mounted adjacent said turning assembly, said header carriage including opposed, moveable headers for holding an end disk and positioning the end disks on the ends of the roll, a pair of opposed and vertically moveable crimper paddles positioned above said header carriage, drive mechanism for rotating each of said crimper paddles and a motor operatively connected to said crimper paddles for rotating said crimper paddles, and a lift positioned below said turning assembly for lifting the roll upwardly from said turning assembly, said lift comprising a plurality of pneumatic cushion assemblies.

11. A wrapping machine for a roll having a longitudinal centerline and an outer cylindrical surface comprising, a frame including opposed side members and top member extending between said opposed side members, a turning assembly positioned below said top member, said turning assembly including a driven member for rotating the roll, a motor operatively connected to said driven member, a header carriage mounted adjacent said turning assembly, said header carriage including opposed, moveable headers for holding an end disk and positioning the end disks on the ends of the roll, a pair of opposed and vertically moveable crimper paddles positioned above said header carriage, drive mechanism for rotating each of said crimper paddles and a motor operatively connected to said crimper paddles for rotating said crimper paddles, and a lift positioned below said turning assembly for lifting the roll upwardly from said turning assembly, and an adhesive head assembly operatively mounted on said frame, above the roll, for applying an adhesive layer on said surface, parallel to said longitudinal centerline.

12. A wrapping machine for a roll comprising, a frame including opposed side members and top member extending between said opposed side members, a turning assembly positioned below said top member, said turning assembly including a driven member for rotating the roll, a motor operatively connected to said driven member, a header carriage mounted adjacent said turning assembly, said header carriage including opposed, moveable headers for holding an end disk and positioning the end disks on the ends of the roll, a pair of opposed and vertically moveable crimper paddles positioned above said header carriage, drive mechanism for rotating each of said crimper paddles and a motor operatively connected to said crimper paddles for rotating said crimper paddles, a lift positioned below said turning assembly for lifting the roll upwardly from said turning assembly and a knife assembly having a knife edge, a web of wrapping material extending toward the roll, said knife edge positioned adjacent the web, said knife edge being moveable to engage and sever the web.

* * * * *